US006098234A

United States Patent [19]

Jackson, Jr.

[11] Patent Number: 6,098,234

[45] Date of Patent: Aug. 8, 2000

[54] CLEANING SYSTEM

[76] Inventor: Andrew Jackson, Jr., 8835 Longacre, Detroit, Mich. 48228

[21] Appl. No.: 09/251,868

[22] Filed: Feb. 17, 1999

[51] Int. Cl.[7] ..... A47K 7/02

[52] U.S. Cl. ..... 15/118; 15/104.94; 15/227

[58] Field of Search ..... 2/159, 161.4, 161.6, 2/161.8, 167; 15/104.94, 118, 227

[56] References Cited

U.S. PATENT DOCUMENTS

| | | | |
|---|---|---|---|
| 1,941,320 | 12/1933 | Pamplin | 15/227 |
| 2,795,806 | 6/1957 | Suttles | 15/227 |
| 3,775,014 | 11/1973 | Rosborne | 15/104.94 |
| 4,154,542 | 5/1979 | Rasmason | 15/227 |
| 4,953,250 | 9/1990 | Brown . | |
| 5,022,517 | 6/1991 | Benitez . | |
| 5,462,378 | 10/1995 | Webb . | |
| 5,486,064 | 1/1996 | Schultz . | |
| 5,704,723 | 1/1998 | Salisian . | |
| 5,727,277 | 3/1998 | Chien . | |
| 6,016,571 | 1/2000 | Guzman et al. | 15/227 |
| 6,018,837 | 2/2000 | Andreu | 15/227 |

*Primary Examiner*—Terrence R. Till
*Attorney, Agent, or Firm*—Joseph N. Breaux

[57] ABSTRACT

A cleaning system that is convenient and efficient. The cleaning system includes a glove assembly, a wash cloth assembly, and a buffer cloth assembly. The glove assembly includes a cloth glove shell with an elastic wrist band, six hook and pile scrubber fastening sections, six detachable scrub sections, an elongated accessory hook and pile fastener strip secured to the palm area of the glove shell, and a glove assembly soap receiving compartment within the glove shell that is accessible through an access opening formed through an interior palm surface of the glove shell and having a hook and pile closure sealing flap for sealing the access opening.

2 Claims, 5 Drawing Sheets

FIG.3
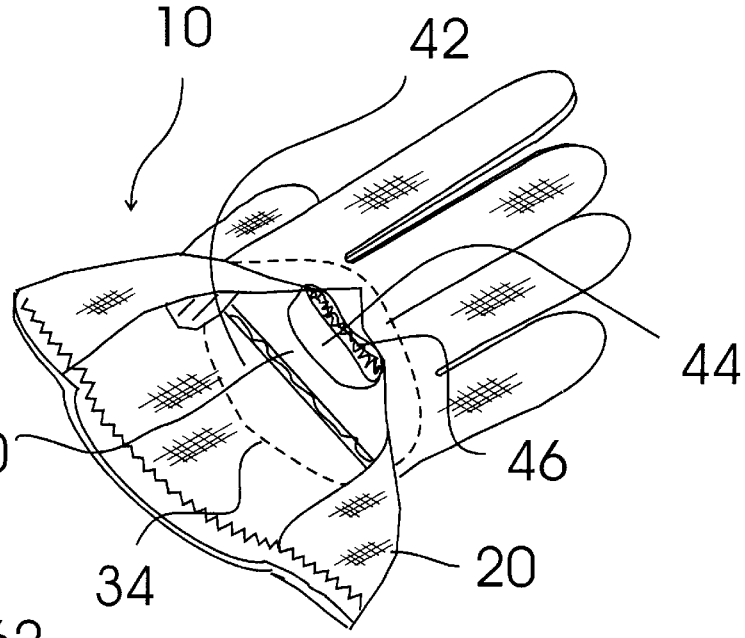
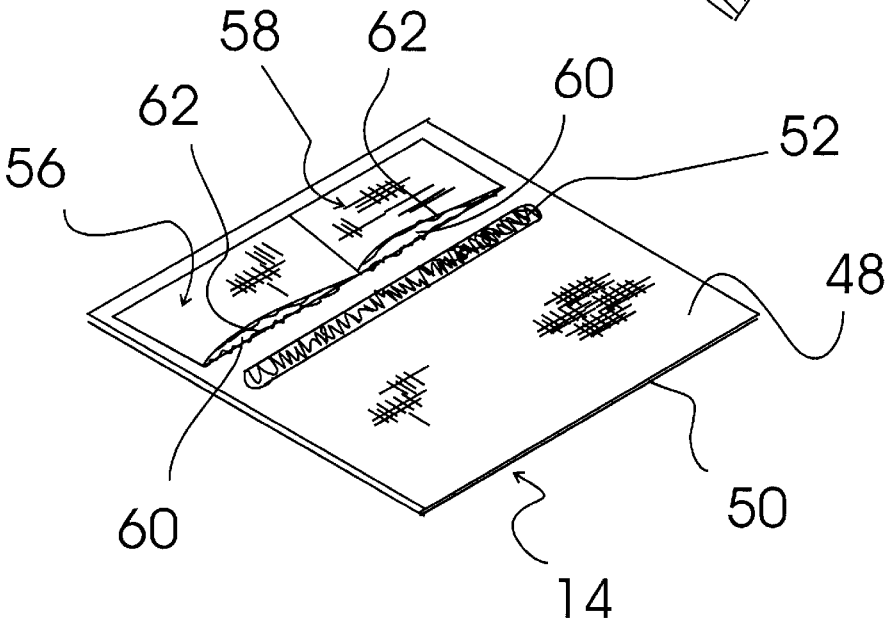
FIG.4

CLEANING SYSTEM

TECHNICAL FIELD

The present invention relates to cleaning devices and more particularly to a cleaning system including a glove assembly, a wash cloth assembly, and a buffer cloth assembly; the glove assembly including a cloth glove shell with an elastic wrist band, six hook and pile scrubber fastening sections, six detachable scrub sections, an elongated accessory hook and pile fastener strip secured to the palm area of the glove shell, and a glove assembly soap receiving compartment within the glove shell that is accessible through an access opening formed through an interior palm surface of the glove shell and having a hook and pile closure sealing flap for sealing the access opening; one of the six hook and pile scrubber fastening sections being attached to the tip of each of five fingers of the glove shell; one of the six hook and pile scrubber fastening sections being attached to an exterior surface palm area of the glove shell; each of the six detachable scrub sections having a companionate hook and pile fastener backed surface that is securable to one of the six hook and pile scrubber fastening sections; five of the six detachable scrub sections being sized to fit over and attach to the scrubber fastening sections at the tips of the five fingers of the glove shell; one of the six detachable scrub sections being sized to fit over and attach to the palm area scrubber fastening section; the wash cloth assembly including an absorbent cloth section having a use side and a wash cloth attachment side; the wash cloth attachment side having an elongated companionate hook and pile wash cloth attachment strip that is companionate with the accessory hook and pile fastener strip of the glove shell attached thereto and first and second sealable wash cloth pockets provided thereon; each of the first and second washcloth pockets having a wash cloth pocket access opening sealable with a hook and pile closure; the buffer cloth assembly including an absorbent member having a buffing side and a buffer attachment side; the buffer attachment side having a centrally positioned, elongated companionate hook and pile buffer cloth attachment strip that is companionate with the accessory hook and pile fastener strip of the glove shell provided thereon and a circular, sealable, buffer cloth pocket with a buffer cloth pocket access opening sealable with a hook and pile closure.

BACKGROUND ART

Cleaning can be an inconvenient, time consuming activity. It would be a benefit, therefore, to have a cleaning system that allowed a user to conveniently and efficiently clean a variety of surfaces and items including floors, cars, and people. Because many surfaces are advantageously waxed, polished or buffed after cleaning, it would be a further advantage to have a cleaning that included a buffing assembly that could be used to buff, wax and polish surfaces.

GENERAL SUMMARY DISCUSSION OF INVENTION

It is thus an object of the invention to provide a cleaning system that is convenient and efficient.

It is a further object of the invention to provide a cleaning system that includes a buffing assembly.

It is a still further object of the invention to provide a cleaning system that includes a glove assembly, a wash cloth assembly, and a buffer cloth assembly; the glove assembly including a cloth glove shell with an elastic wrist band, six hook and pile scrubber fastening sections, six detachable scrub sections, an elongated accessory hook and pile fastener strip secured to the palm area of the glove shell, and a glove assembly soap receiving compartment within the glove shell that is accessible through an access opening formed through an interior palm surface of the glove shell and having a hook and pile closure sealing flap for sealing the access opening; one of the six hook and pile scrubber fastening sections being attached to the tip of each of five fingers of the glove shell; one of the six hook and pile scrubber fastening sections being attached to an exterior surface palm area of the glove shell; each of the six detachable scrub sections having a companionate hook and pile fastener backed surface that is securable to one of the six hook and pile scrubber fastening sections; five of the six detachable scrub sections being sized to fit over and attach to the scrubber fastening sections at the tips of the five fingers of the glove shell; one of the six detachable scrub sections being sized to fit over and attach to the palm area scrubber fastening section; the wash cloth assembly including an absorbent cloth section having a use side and a wash cloth attachment side; the wash cloth attachment side having an elongated companionate hook and pile wash cloth attachment strip that is companionate with the accessory hook and pile fastener strip of the glove shell attached thereto and first and second sealable wash cloth pockets provided thereon; each of the first and second washcloth pockets having a wash cloth pocket access opening sealable with a hook and pile closure; the buffer cloth assembly including an absorbent member having a buffing side and a buffer attachment side; the buffer attachment side having a centrally positioned, elongated companionate hook and pile buffer cloth attachment strip that is companionate with the accessory hook and pile fastener strip of the glove shell provided thereon and a circular, sealable, buffer cloth pocket with a buffer cloth pocket access opening sealable with a hook and pile closure.

It is a still further object of the invention to provide a cleaning system that accomplishes some or all of the above objects in combination.

Accordingly, a cleaning system is provided. The cleaning system a cleaning system that includes a glove assembly, a wash cloth assembly, and a buffer cloth assembly; the glove assembly including a cloth glove shell with an elastic wrist band, six hook and pile scrubber fastening sections, six detachable scrub sections, an elongated accessory hook and pile fastener strip secured to the palm area of the glove shell, and a glove assembly soap receiving compartment within the glove shell that is accessible through an access opening formed through an interior palm surface of the glove shell and having a hook and pile closure sealing flap for sealing the access opening; one of the six hook and pile scrubber fastening sections being attached to the tip of each of five fingers of the glove shell; one of the six hook and pile scrubber fastening sections being attached to an exterior surface palm area of the glove shell; each of the six detachable scrub sections having a companionate hook and pile fastener backed surface that is securable to one of the six hook and pile scrubber fastening sections; five of the six detachable scrub sections being sized to fit over and attach to the scrubber fastening sections at the tips of the five fingers of the glove shell; one of the six detachable scrub sections being sized to fit over and attach to the palm area scrubber fastening section; the wash cloth assembly including an absorbent cloth section having a use side and a wash cloth attachment side; the wash cloth attachment side having an elongated companionate hook and pile wash cloth attachment strip that is companionate with the accessory hook and pile fastener strip of the glove shell attached thereto and first and second sealable wash cloth pockets provided thereon; each of the first and second washcloth pockets having a wash cloth pocket access opening sealable with a hook and pile closure; the buffer cloth assembly including an absorbent member having a buffing side and a buffer attachment side; the buffer attachment side having a centrally positioned, elongated companionate hook and pile buffer cloth attachment strip that is companionate with the accessory hook and pile fastener strip of the glove shell provided thereon and a circular, sealable, buffer cloth pocket with a buffer cloth pocket access opening sealable with a hook and pile closure.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 3 is perspective view of the back side of the exemplary glove assembly of FIG. 1 in isolation with the back of the terry cloth glove shell slit open to show the access opening into the glove assembly soap receiving compartment formed through the interior palm surface of the glove shell with the hook and pile closure sealing flap in the open position.

FIG. 4 is a perspective view of the attachment side of the exemplary wash cloth assembly of FIG. 1 showing the elongated companionate hook and pile wash cloth attachment strip that is companionate with the accessory hook and pile fastener strip of the glove shell; and the first and second sealable wash cloth pockets each with a wash cloth pocket access opening sealable with a hook and pile closure.

EXEMPLARY MODE FOR CARRYING OUT THE INVENTION

Figure 1:
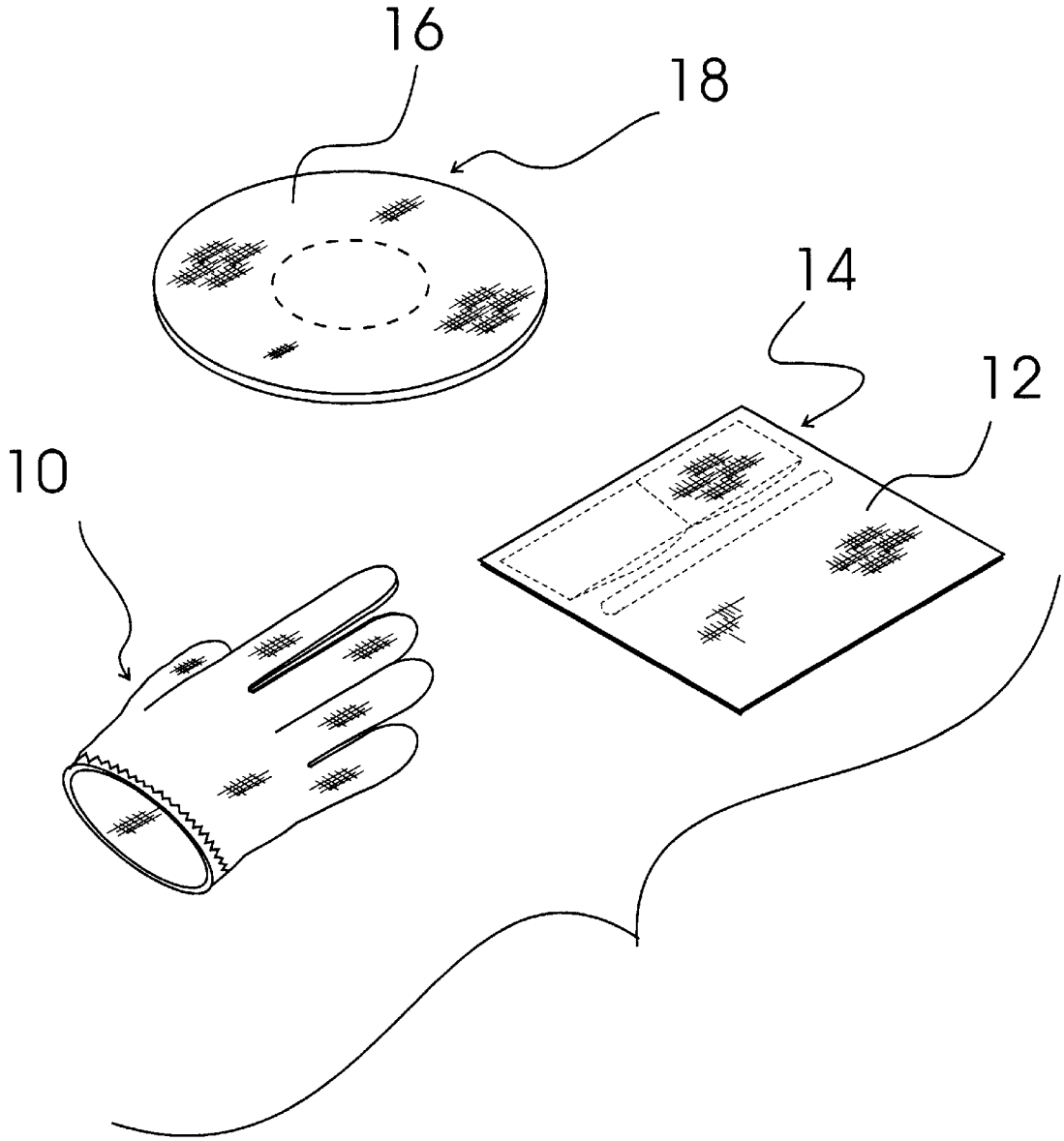
FIG. 1 is a perspective view of the back side of a right handed embodiment of an exemplary glove assembly, the use side of an exemplary wash cloth assembly, and the buffing side of an exemplary buffer cloth assembly of the cleaning system of the present invention.

FIG. 1 shows an exemplary glove assembly, generally designated 10; the use side 12 of an exemplary wash cloth assembly, generally designated 14; and the buffing side 16 of an exemplary buffer cloth assembly, generally designated 18, of the cleaning system of the present invention.

Figure 2:
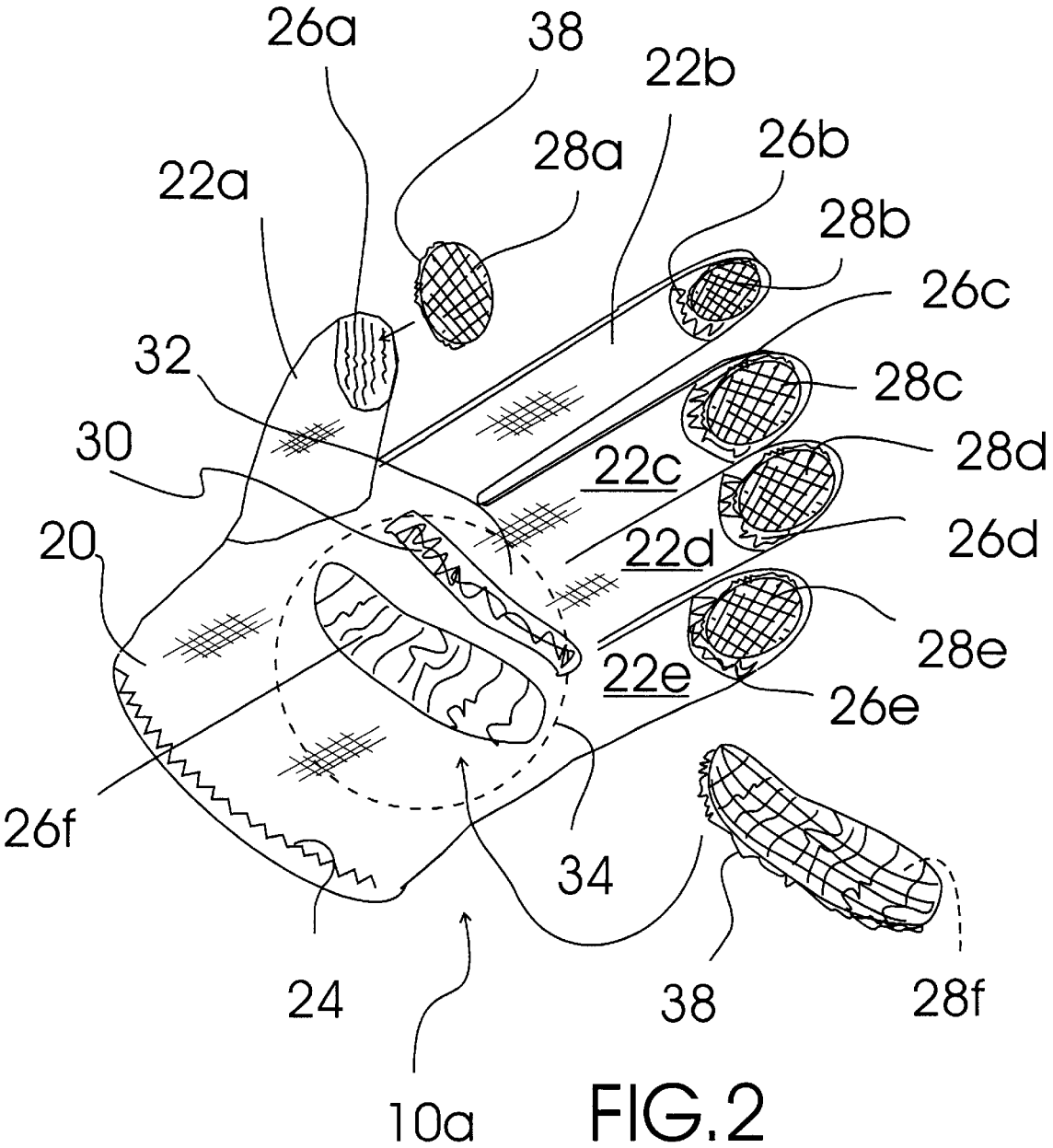
FIG. 2 is a perspective view of the palm side of a left handed embodiment of the glove assembly which is a mirror image of the right handed glove assembly of FIG. 1 in isolation showing the terry cloth glove shell with the elastic wrist band; the hook and pile scrubber fastening sections at the tips of each of the fingers (only one shown) and the palm area; the six detachable scrub sections each with a companionate hook and pile fastener backed surface, five sized to fit over and attach to the scrubber fastening sections at the tips of the fingers of the glove shell and one sized to fit over and attach to the palm area scrubber fastening section; and the elongated accessory hook and pile fastener strip stitched to the center of the palm area of the glove shell.

FIG. 2 shows the palm side of a left handed embodiment of the glove assembly 10*a*, which is a mirror image of the right handed glove assembly 10 of FIG. 1, in isolation. Glove assembly 10*a* includes a terry cloth glove shell 20 having five fingers 22*a–e*, an elastic wrist band 24, six hook and pile scrubber fastening sections 26*a–f* (only 26*a*, 26*f* shown), six detachable scrub sections 28*a–f*, an elongated accessory hook and pile fastener strip 30 secured to a palm area 32 of glove shell 20, and a glove assembly soap receiving compartment 34 (shown in dashed lines, see also FIG. 3) formed within glove shell 20. One of hook and pile scrubber fastening sections 26*a–e* is attached to the tip of each of the five fingers 22*a–e* of glove shell 20. One of hook and pile scrubber fastening sections 26*f* is stitched to an exterior surface palm area 32 of glove shell 20. Each of the six detachable scrub sections 28*a–f* has a companionate hook and pile fastener backed surface 38 that is securable to one of the six hook and pile scrubber fastening sections 26*a–f*. Detachable scrub sections 28*a–e* are sized to fit over and attach to the scrubber fastening sections 26*a–e* at the tips of the five fingers 22*a–e* of glove shell 20. Detachable scrub section 28*f* is sized to fit over and attach to palm area scrubber fastening section 26*f*. The term detachable scrub section is used herein to mean a section of material such as sponge, nylon scrub material and loofa type sponge, that is used as scrubber. In this embodiment, detachable scrub sections 28*a–f* are sections of nylon scrub material.

FIG. 3 is a perspective view of the back side of exemplary glove assembly 10 of FIG. 1 in isolation with the back of terry cloth glove shell 20 slit open to show an access opening 40 in connection with a glove assembly soap receiving compartment 34. Access opening 40 is formed through the interior palm surface 42 of glove shell 20 and is sealable with a flap 44 having a hook and pile closure 46. In use, cleaning agents are placed within glove assembly soap receiving compartment 34 to provide a supply of cleaning agent to the palm area 32 (FIG. 3).

FIG. 4 shows the attachment side 48 of an absorbent, rectangular terry cloth section 50 forming a portion of wash cloth assembly 14 of FIG. 1. An elongated companionate hook and pile wash cloth attachment strip 52 is stitched to the center of attachment side 48. Companionate hook and pile wash cloth attachment strip 52 is companionate with the accessory hook and pile fastener strip 30 of glove shell 20 and is used to secure wash cloth assembly 14 securely to the palm area 32 (FIG. 2) of glove shell 20. First and second sealable wash cloth pockets, generally designated 56,58, each with a wash cloth pocket access opening 60, are provided on attachment surface 48. Access openings 60 are each sealable with a hook and pile closure 62. In use, first and second sealable wash cloth pockets 56,58 are filled with a cleaning agent, such as soap powder, which mixes with water and seeps through to use side 12 (FIG. 1).

Figure 5:
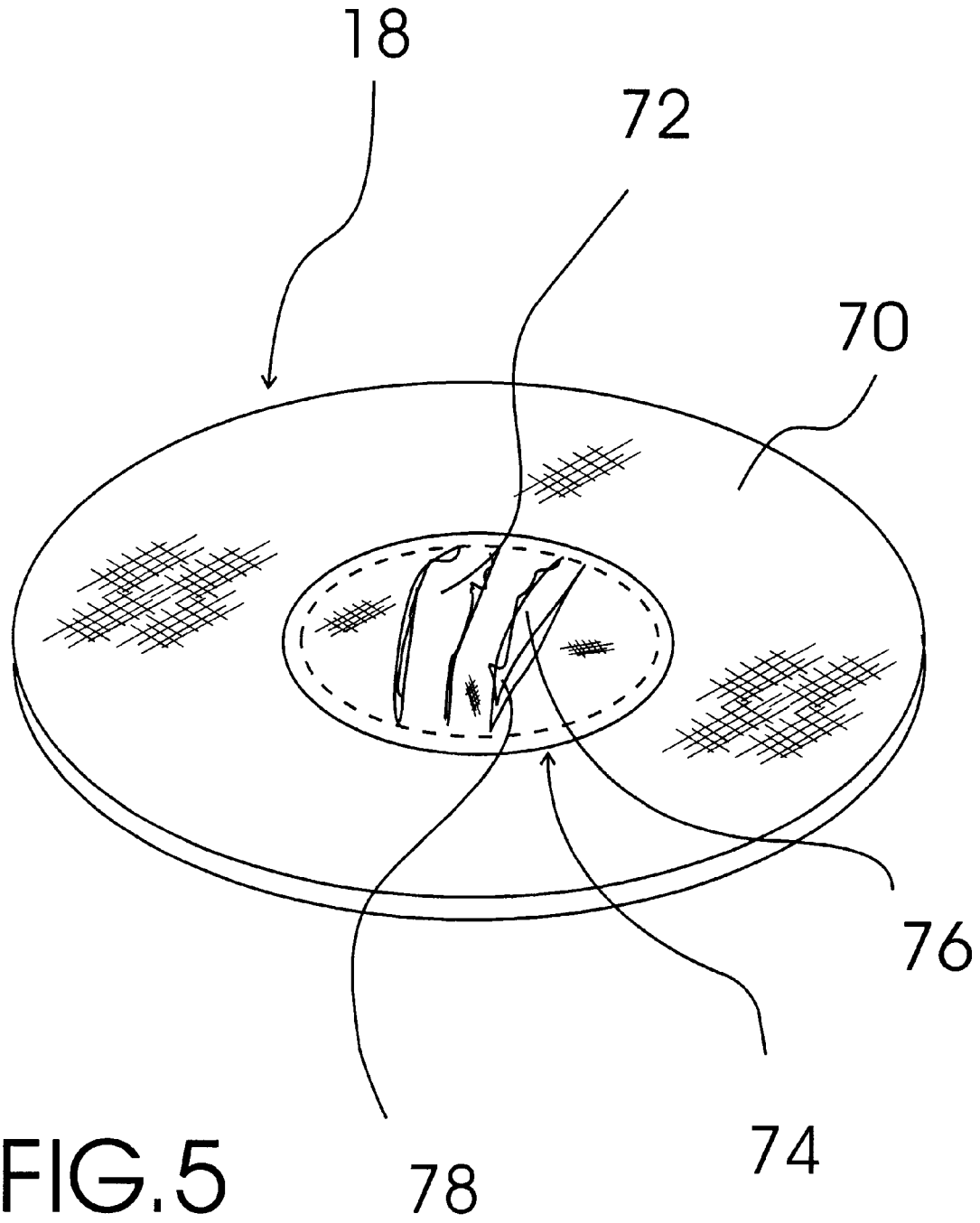
FIG. 5 is perspective view of the attachment side of the exemplary buffer cloth assembly of FIG. 1 showing the elongated companionate hook and pile buffer cloth attachment strip that is companionate with the accessory hook and pile fastener strip of the glove shell; and the circular, sealable, buffer cloth pocket with a buffer cloth pocket access opening sealable with a hook and pile

FIG. 5 shows the attachment side 70 of exemplary buffer cloth assembly 18 of FIG. 1. Buffer cloth assembly 18 is constructed from terry cloth and includes an elongated companionate hook and pile buffer cloth attachment strip 72 that is companionate with the accessory hook and pile fastener strip 30 (FIG. 2) of glove shell 20 (FIG. 2). A circular, sealable, buffer cloth pocket, generally designated 74, is provided in the center of attachment side 70 that includes a buffer cloth pocket access opening 76 that is sealable with a hook and pile closure 78. In use, buffer cloth pocket 74 is filled with a polish or wax and buffer cloth pocket access opening 76 sealed prior to attaching buffer cloth attachment strip 72 to accessory hook and pile fastener strip 30 (FIG. 2) of glove shell 20 (FIG. 2). Pressure from the user's hand then forces the polish or wax though the terry cloth fabric to buffing side 16 (FIG. 1) which is then used to polish or wax a surface.

Figure 6:
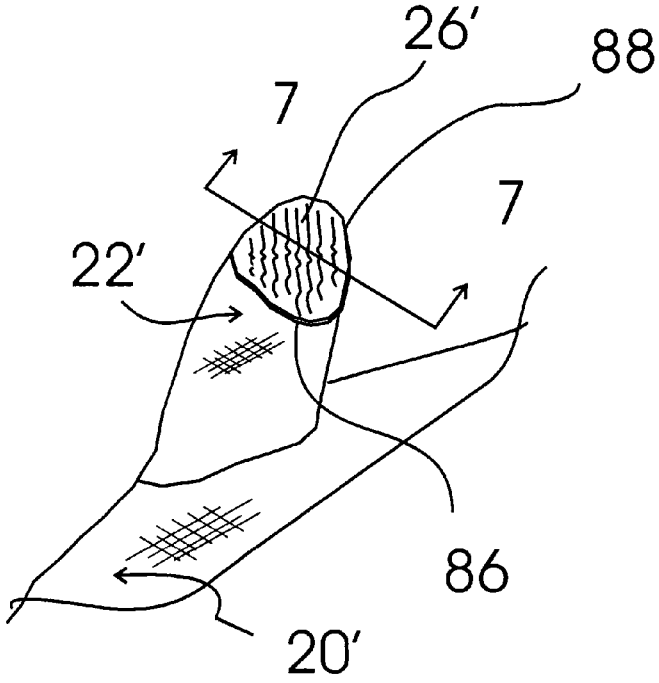
FIG. 6 is partial perspective view of the thumb of the glove shell showing a second mechanism for securing a hook and pile scrubber fastening section to the thumb and finger tips of the glove shell by using and invertible tip fastener section stitched around the tip perimeter of the finger or thumb and having a hook and pile faster surface facing away from the finger and thumb pads when the invertible tip fastener section is on the finger and thumb pad side of the finger or thumb of the glove shell.
Figure 8:
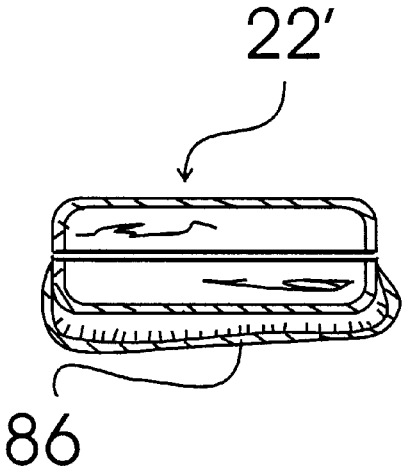
FIG. 8 is cross sectional view of the thumb tip of FIG. 7 inverted.
Figure 7:
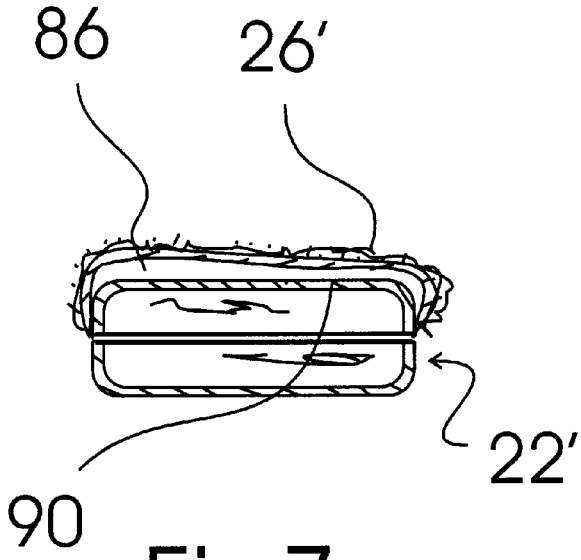
FIG. 7 is cross sectional view through the thumb and the invertible tip fastener section along the line 7—7 showing the hook and pile fastener surface facing away from the thumb pad surface of the glove shell and the interior of the thumb tip.

FIG. 6 shows a second mechanism for securing a hook and pile scrubber fastening section 26' to the thumb 22' and finger tips 22' of a glove shell 20' by using and invertible tip fastener section 86 that is stitched around the tip perimeter 88 of each of the finger tips or thumb 22'. Referring to FIG. 7, invertible tip fastener section 86 has hook and pile faster surface 26' facing away from the finger and thumb pads 90 when invertible tip fastener section 86 is on the finger and thumb pad 90 side of finger or thumb 22'. Referring to FIG. 8, when it is not desired to use a detachable scrub section 28 (FIG. 2), invertible tip fastener sections 86 can be flipped over the finger or thumb 22' tip and glove shell 20' (FIG. 6) used as desired.

It can be seen from the preceding description that a cleaning system has been provided that is convenient and efficient; that includes a buffing assembly; and that includes a glove assembly, a wash cloth assembly, and a buffer cloth assembly; the glove assembly including a cloth glove shell with an elastic wrist band, six hook and pile scrubber fastening sections, six detachable scrub sections, an elongated accessory hook and pile fastener strip secured to the palm area of the glove shell, and a glove assembly soap receiving compartment within the glove shell that is accessible through an access opening formed through an interior palm surface of the glove shell and having a hook and pile closure sealing flap for sealing the access opening; one of the six hook and pile scrubber fastening sections being attached to the tip of each of five fingers of the glove shell; one of the six hook and pile scrubber fastening sections being attached to an exterior surface palm area of the glove shell; each of the six detachable scrub sections having a companionate hook and pile fastener backed surface that is securable to one of the six hook and pile scrubber fastening sections; five of the six detachable scrub sections being sized to fit over and attach to the scrubber fastening sections at the tips of the five fingers of the glove shell; one of the six detachable scrub sections being sized to fit over and attach to the palm area scrubber fastening section; the wash cloth assembly including an absorbent cloth section having a use side and a wash cloth attachment side; the wash cloth attachment side having an elongated companionate hook and pile wash cloth attachment strip that is companionate with the accessory hook and pile fastener strip of the glove shell attached thereto and first and second sealable wash cloth pockets provided thereon; each of the first and second washcloth pockets having a wash cloth pocket access opening sealable with a hook and pile closure; the buffer cloth assembly including an absorbent member having a buffing side and a buffer attachment side; the buffer attachment side having a centrally positioned, elongated companionate hook and pile buffer cloth attachment strip that is companionate with the accessory hook and pile fastener strip of the glove shell provided thereon and a circular, sealable, buffer cloth pocket with a buffer cloth pocket access opening sealable with a hook and pile closure.

It is noted that the embodiment of the cleaning system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cleaning system comprising:

a glove assembly;

a wash cloth assembly; and a buffer cloth assembly;

said glove assembly including a cloth glove shell with an elastic wrist band, six hook and pile scrubber fastening sections, six detachable scrub sections, an elongated accessory hook and pile fastener strip secured to an exterior palm area of said glove shell, and a glove assembly soap receiving compartment within said glove shell that is accessible through an access opening formed through an interior palm surface of said glove shell and having a hook and pile closure sealing flap for sealing said access opening;

one of said six hook and pile scrubber fastening sections being attached to a tip of each of five fingers of said glove shell;

one of said six hook and pile scrubber fastening sections being attached to said exterior palm area of said glove shell;

each of said six detachable scrub sections having a companionate hook and pile fastener backed surface that is securable to one of said six hook and pile scrubber fastening sections;

five of said six detachable scrub sections being sized to fit over and attach to said scrubber fastening sections at said tips of said five fingers of said glove shell;

one of said six detachable scrub sections being sized to fit over and attach to said palm area scrubber fastening section;

said wash cloth assembly including an absorbent cloth section having a use side and a wash cloth attachment side;

said wash cloth attachment side having an elongated companionate hook and pile wash cloth attachment strip that is companionate with said accessory hook and pile fastener strip of said glove shell attached thereto and first and second sealable wash cloth pockets provided thereon;

each of said first and second washcloth pockets having a wash cloth pocket access opening sealable with a hook and pile closure;

said buffer cloth assembly including an absorbent member having a buffing side and a buffer attachment side;

said buffer attachment side having a centrally positioned, elongated companionate hook and pile buffer cloth attachment strip that is companionate with said accessory hook and pile fastener strip of said glove shell provided thereon and a circular, sealable, buffer cloth pocket with a buffer cloth pocket access opening sealable with a hook and pile closure.

2. The cleaning system of claim 1 wherein:

invertible tip fastener sections are stitched to each of said five fingers of said glove shell; and one of said six hook and pile scrubber fastening sections is attached to each said invertible tip fastener section.

* * * * *